US005361839A

United States Patent [19]

Griffith et al.

[11] Patent Number: 5,361,839

[45] Date of Patent: Nov. 8, 1994

[54] FULL BORE SAMPLER INCLUDING INLET AND OUTLET PORTS FLANKING AN ANNULAR SAMPLE CHAMBER AND PARAMETER SENSOR AND MEMORY APPARATUS DISPOSED IN SAID SAMPLE CHAMBER

[75] Inventors: Michael J. Griffith, Needville; Ervin Randermann, Jr., Beasley, both of Tex.

[73] Assignee: Schlumberger Technology Corporation, Houston, Tex.

[21] Appl. No.: 36,616

[22] Filed: Mar. 24, 1993

[51] Int. Cl.[5] ..... E21B 49/08

[52] U.S. Cl. ..... 166/264; 166/169; 166/65.1

[58] Field of Search ..... 166/53, 64, 65.1, 100, 166/169, 264; 73/863.01

[56] References Cited

U.S. PATENT DOCUMENTS

| | | | |
|---|---|---|---|
| 3,411,587 | 11/1968 | Bournazel . | |
| 4,502,537 | 3/1985 | Carter, Jr. . | |
| 4,553,598 | 11/1985 | Meek et al. . | |
| 4,583,595 | 4/1986 | Czernichow et al. . | |
| 4,597,439 | 7/1986 | Meek . | |
| 4,610,308 | 9/1986 | Meek . | |
| 4,721,157 | 1/1988 | Berzin . | |
| 4,787,447 | 11/1988 | Christensen | 166/169 |
| 4,878,538 | 11/1989 | Christensen | 166/264 |
| 4,896,722 | 1/1990 | Upchurch | 166/264 X |
| 4,903,765 | 2/1990 | Zunkel | 166/264 X |
| 5,058,674 | 10/1991 | Schultz et al. | 166/264 |
| 5,137,086 | 8/1992 | Stokley et al. | 166/264 |
| 5,153,832 | 10/1992 | Anderson et al. . | |
| 5,240,072 | 8/1993 | Schultz et al. | 166/264 X |

*Primary Examiner*—Ramon S. Britts
*Assistant Examiner*—Frank S. Tsay
*Attorney, Agent, or Firm*—Henry N. Garrana; John H. Bouchard

[57] ABSTRACT

A formation fluid sampler adapted to be disposed in a wellbore includes a full bore and an outer housing. The outer housing includes an annular sample chamber having a first port disposed on one side of the chamber and a second port disposed on the other side of the chamber. The annular sample chamber further includes a fluid sample parameter transducer adapted for measuring a parameter of the fluid sample trapped in the annular sample chamber, and an EPROM memory for instantly storing the parameter measured by the transducer when the sample was initially taken by the sampler. The sampler also includes a piston disposed within the outer housing and adapted to move axially in the sampler in response to an annulus pressure around the sampler. The piston defines the full bore of the sampler and includes a first port adapted to move into congruence with the first port of the outer housing and a second port adapted to move into congruence with the second port of the outer housing in response to the axial movement of the piston. When the ports are congruent, one side of the annular sample chamber fluidly communicates with the full bore of the sampler and the other side of the annular sample chamber fluidly communicates with the full bore of the sampler. A full bore valve is connected to the piston and is disposed within the full bore of the sampler. When the piston moves axially in response to an increase of the annulus pressure around the sampler, the first and second ports move into congruence and and the full bore valve opens the full bore of the sampler.

27 Claims, 6 Drawing Sheets

FIG. 3
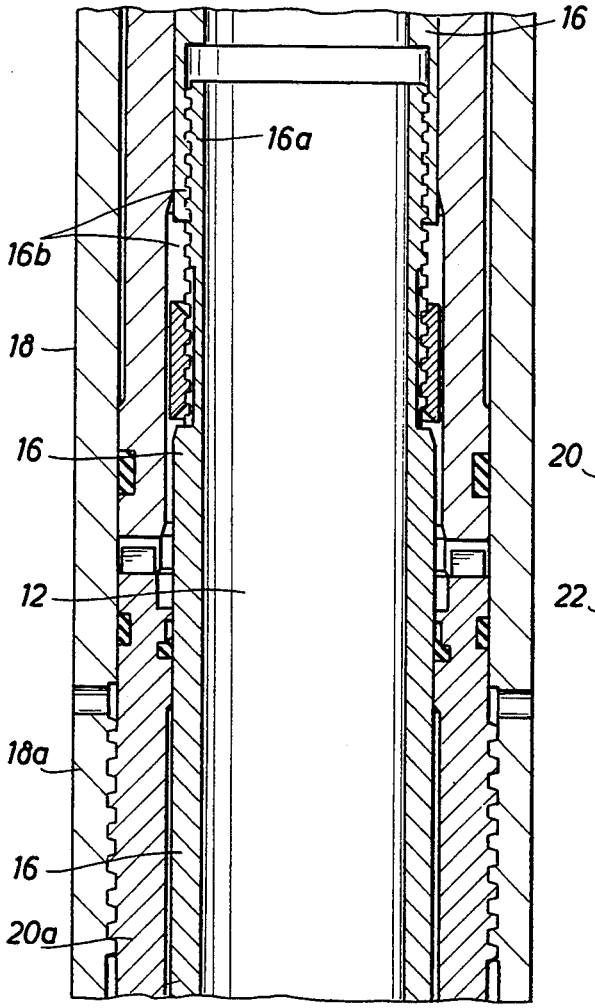
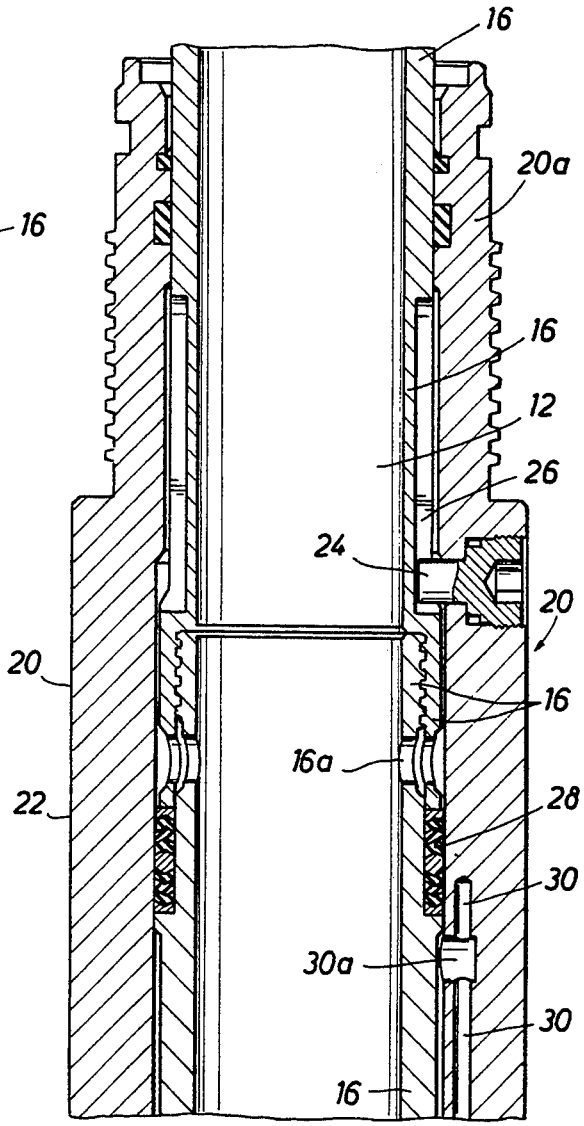
FIG. 4

FIG. 5
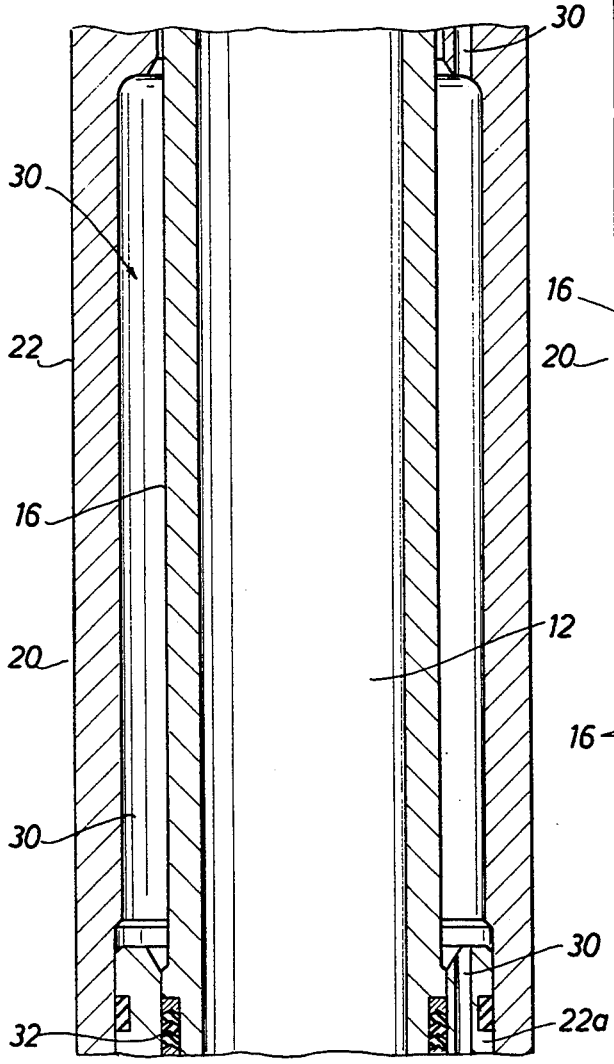
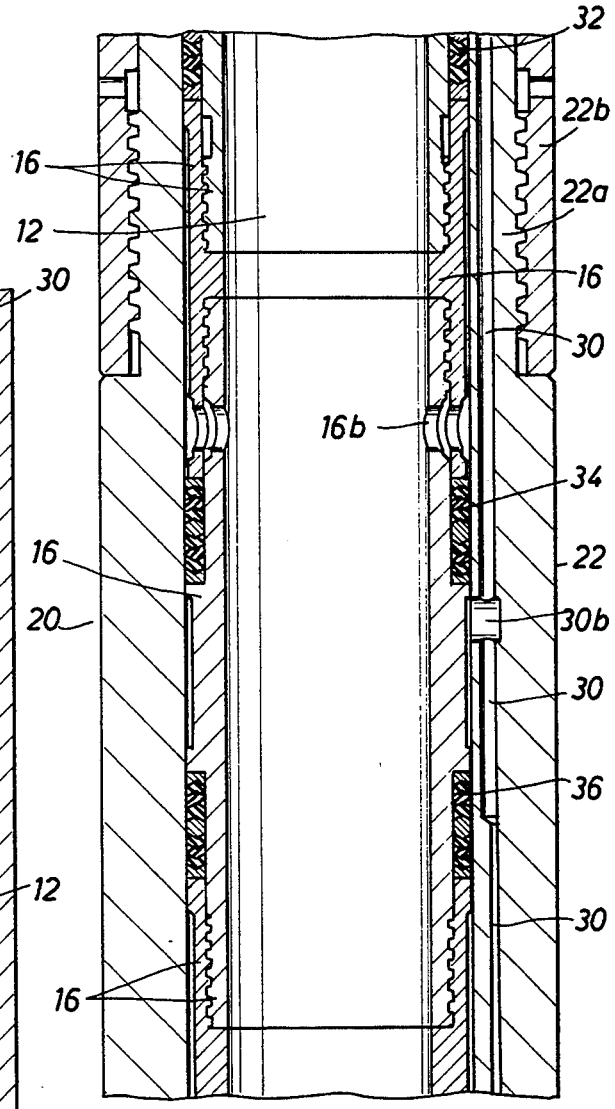
FIG. 6

FULL BORE SAMPLER INCLUDING INLET AND OUTLET PORTS FLANKING AN ANNULAR SAMPLE CHAMBER AND PARAMETER SENSOR AND MEMORY APPARATUS DISPOSED IN SAID SAMPLE CHAMBER

BACKGROUND OF THE INVENTION

The subject matter of the present invention relates to a formation fluid sampler adapated to be disposed in a wellbore, and more particularly, to a full bore formation fluid sampler apparatus having an annular sample chamber flanked on both sides by inlet and outlet ports which allow fluid communication with the full bore of the sampler and further including a parameter sensor transducer disposed in the sample chamber for measuring a parameter of the fluid in the sample chamber and a memory apparatus connected to the sensor transducer for storing the parameter of the fluid in a memory.

Formation fluid samplers for use in a wellbore are well known in the art. Such samplers are designed to trap a sample of a formation fluid in the sampler when the formation fluid flows from a perforated formation in the wellbore. The fluid sample is subsequently retrieved from the sampler for analysis when the sampler is withdrawn to a surface of the wellbore. An example of a formation fluid sampler is disclosed in U.S. Pat. No. 4,502,537 to Carter. The Carter sampler discloses a sampler having an annular sample chamber disposed around a full bore for trapping a sample of formation fluid flowing within the full bore of the sampler. However, the Carter sampler is not connected to or associated with a full bore valve for opening and closing ports of the annular sample chamber of the Carter sampler in synchronism with the opening and closing of the full bore valve. In addition, the Carter sampler fails to record and memorize a parameter of the fluid sample contained in the annular sample chamber at the moment in time when the fluid sample is taken. Furthermore, the Carter sampler fails to disclose a pair of ports flanking the annular sample chamber and communicating the full bore with both sides of the annular sample chamber, where each port includes a first port disposed through a wall of the annular sample chamber and a second port disposed through a piston and adapted to move into congruence with the first port in response to an axial movement of the piston.

SUMMARY OF THE INVENTION

Accordingly, it is a primary object of the present invention to provide a formation fluid sampler adapted to be disposed in a wellbore including a full bore, an annular sample chamber and a transducer disposed in the annular sample chamber adapted for measuring a parameter of a fluid trapped in the sample chamber.

It is a further object of the present invention to provide a formation fluid sampler adapted to be disposed in a wellbore including a full bore, an annular sample chamber, a transducer disposed in the annular sample chamber adapted for measuring a parameter of a fluid trapped in the sample chamber, and a memory connected to the transducer in the annular sample chamber for storing the parameter of the fluid measured by the transducer, the stored parameter representing the parameter of the fluid which existed at the moment in time when the fluid was initially trapped in the annular sample chamber.

It is a further object of the present invention to provide a formation fluid sampler adapted to be disposed in a wellbore including a full bore, an annular sample chamber, an inlet port disposed on one side of the sample chamber communicating the full bore with the sample chamber and an outlet port disposed on the other side of the sample chamber communicating the sample chamber with the full bore, the inlet and outlet ports each including a first port disposed through a wall of the sample chamber and a second port disposed through a piston and adapted to move into congruence with the first port in response to an axial movement of the piston.

It is a further object of the present invention to provide a formation fluid sampler adapted to be disposed in a wellbore including a full bore, an annular sample chamber, a pair of ports flanking both sides of the annular sample chamber, and a full bore valve disposed within the full bore of the sampler for opening and closing the full bore of the sampler in synchronism with the opening and closing of the pair of ports flanking the annular sample chamber.

It is a further object of the present invention to provide a formation fluid sampler adapted to be disposed in a wellbore including a full bore, an annular sample chamber, a pair of ports flanking both sides of the annular sample chamber where each port includes a first port disposed through a wall of the sample chamber and a second port disposed through a piston and adapted to move into congruence with the first port in response to an axial movement of the piston, and a full bore valve disposed within the full bore of the sampler for opening and closing the full bore of the sampler in synchronism with the axial movement of the piston and the resultant opening and closing of the pair of ports.

These and other objects of the present invention are accomplished by designing and providing a formation fluid sampler adapted to be disposed in a wellbore. The sampler includes a full bore and an outer housing. The outer housing includes an annular sample chamber having a first port disposed on one side of the chamber and adapted to fluidly communicate the full bore with the annular sample chamber and a second port disposed on the other side of the chamber and adapted to fluidly communicate the full bore with the annular sample chamber. The sampler includes an axially moveable piston disposed within the outer housing and adapted to move axially in the sampler in response to an annulus pressure around the sampler. The piston defines the full bore of the sampler and includes a first port adapted to be moved into congruence with the first port of the outer housing in response to the axial movement of the piston. When the first ports are moved into congruence with one another, one side of the annular sample chamber fluidly communicates with the full bore of the sampler. The piston also includes a second port adapted to be moved into congruence with the second port of the outer housing. When the second ports are moved into congruence with one another, the other side of the annular sample chamber fluidly communicates with the full bore of the sampler. A full bore valve is disposed within the full bore of the sampler and is physically connected to the piston. When the piston moves axially in response to an increase of the annulus pressure around the sampler, the first ports move into congruence with one another, the second ports move into congruence with one another, and the full bore valve opens the full bore of the sampler. As a result, formation fluid flows through the full bore valve within the full bore of the sampler. It also flows from the full bore, into the first ports, and into the annular sample chamber. It further flows from the annular sample chamber, into the second ports, and back into the full bore of the sampler. A subsequent decrease in the annulus pressure closes the full bore valve, closes the first ports, and closes the second ports thereby trapping the formation fluid in the annular sample chamber. The annular sample chamber further includes a pressure and/or temperature transducer adapted for measuring the formation fluid temperature and/or pressure, and an erasable programmable read only memory (EPROM) electrically connected to the transducer for storing in memory the measurement of the formation fluid temperature and/or pressure which was sensed by the transducer when the sample was initially taken. As a result, the temperature and/or pressure of the formation fluid, measured at the moment in time when the fluid sample was taken, will be stored in memory. When the sampler is pulled to the wellbore surface, the measurements of the formation fluid temperature and/or pressure, measured when the sample was first taken, may be read from the EPROM memory.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 2 through 3 illustrate a full bore valve disposed within the full bore of an apparatus adapted to be disposed in a wellbore;

FIGS. 4 through 8 illustrate the full bore fluid sampler of the present invention including the two ports flanking an annular sample chamber and a parameter sensor and memory apparatus disposed within the annular sample chamber.

DETAILED DESCRIPTION OF THE PREFERRED EMBODIMENT

Figure 1:
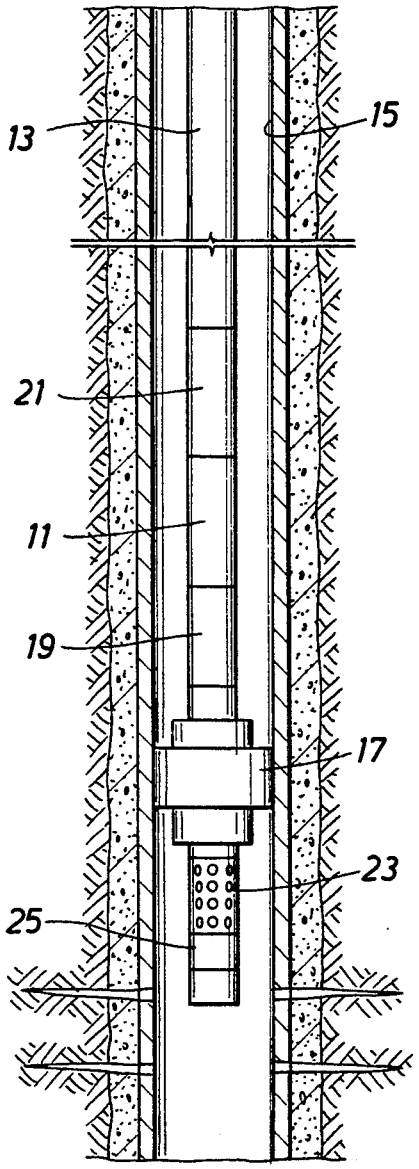
FIG. 1 illustrates a string of full bore well tools such as may typically be used in a cased wellbore and including the full bore sample-collecting apparatus of the present invention.

Referring to FIG. 1, a formation fluid sampler 11 of the present invention and a number of typical full bore well tools are shown tandemly connected to one another and dependently coupled from a lower end of a string of pipe, such as a tubing string 13. Although the new sampler 11 of the present invention can be used in an uncased wellbore, the sampler 11 and other tools will be described as they will be customarily be arranged to conduct a drillstem test in a cased wellbore, as at 15. The other tools include a conventional full bore packer 17 operated as necessary for packing off the wellbore to isolate a particular perforated interval below the packer which is to be tested by successively opening and closing a typical tester 19 included in the string of tools. The test valve 19 is opened and closed in response to controlled increases in the pressure of the drilling mud in the annulus of the wellbore 15 above the packer 17. A reversing valve 21 may also be included in the string of tools. A perforated tail pipe 23 may be dependently coupled to the packer 17 to permit fluids in the isolated interval to enter the string of tools. One or more pressure recorders (not shown) may be enclosed in a suitable housing 25.

FIGS. 2–11 illustrate the new full bore formation fluid sampler 11 of FIG. 1 in accordance with the present invention. The new full bore formation fluid sampler 11 of FIG. 1 actually includes, among other things, a full bore valve 10 in FIG. 2, a fluid sampler 20 in FIGS. 4–8 , and a port 48 communicating an annulus with a spring biased sub 54 in FIGS. 9–11.

Figure 2:
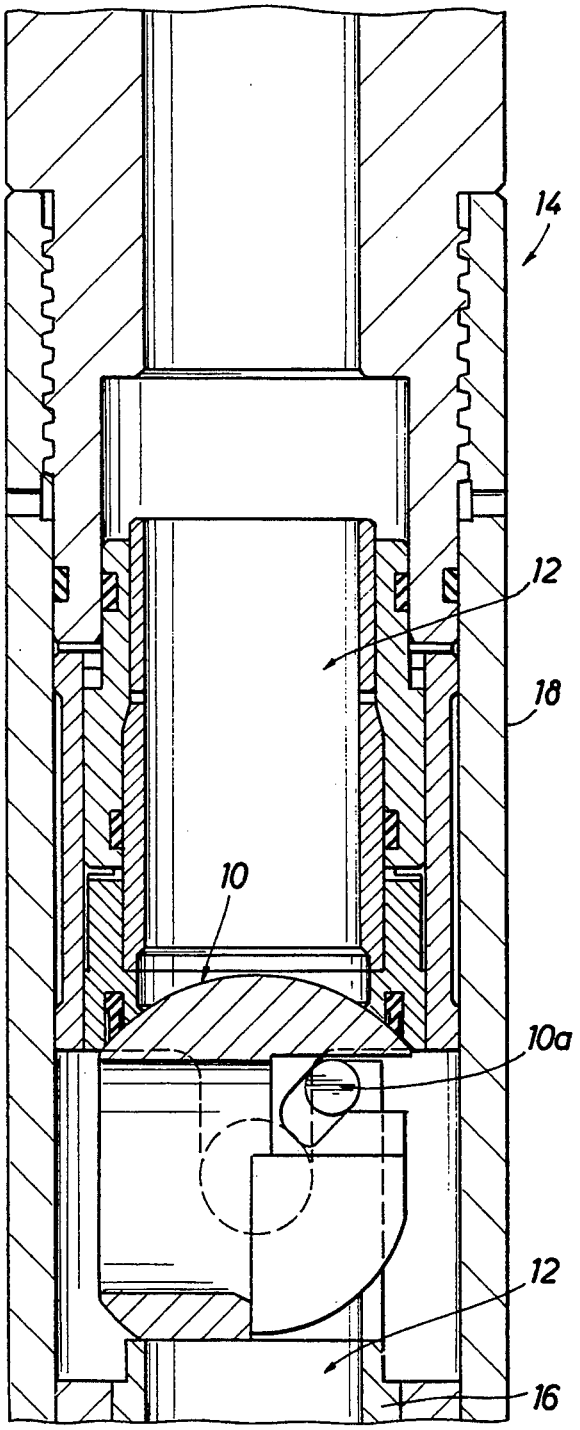

Referring to FIGS. 2–3, these figures illustrate a full bore valve disposed within a full bore section of a downhole wellbore apparatus connected to the sampler of the present invention.

In FIG. 2, a full bore ball valve 10 is disposed within a full bore section 12 of a downhole wellbore apparatus 14. The ball valve 10 is shown in a closed position in FIG. 2. A pin **10*a* of the ball valve 10 is connected to an axially or downwardly moveable piston 16. A downward movement of the piston 16 pulls the pin 10*a* downwardly and rotates the ball valve 10 from the closed position as shown in FIG. 2 to an open position. When the ball valve 10 is in the open position, the full bore section 12 above the ball valve 10 in FIG. 2 fluidly communicates with the full bore section 12 below the ball valve 10**.

In FIG. 3, the piston 16 includes a first threaded connected member **16*a* and a second threadedly connected member 16*b*. However, since both first and second members 16*a* and 16*b* are threadedly connected, a downward movement of the first threadedly connected member 16*a* will also move downwardly the second threadedly connected member 16*b***.

In FIGS. 2 through 3, an outer housing 18 encloses the ball valve 10 and piston 16. In FIG. 3, an end **18*a* of the outer housing 18 is threadedly connected to an end 20*a* of a formation fluid sampler 20 shown in FIGS. 4–8**.

In FIGS. 4–8, FIGS. 4–8 illustrate the fluid sampler portion of the formation fluid sampler 11 of the present invention.

In FIG. 4, a fluid sampler 20 includes an outer housing 22 enclosing the piston 16. A key 24 rides in a slot 26 in the piston 16 preventing the piston 16 from rotating circumferentially within the outer housing 22. The piston 16 includes a first port **16*a* which is transversely disposed through the piston 16. A seal 28 is disposed between the piston 16 and the outer housing 22 in FIG. 4 for preventing any fluid in an annular sample chamber from escaping into the full bore section 12. The outer housing 22 in FIG. 4 includes an annular sample chamber 30 and a first port 30*a* which attempts to fluidly communicate the interior of the annular sample chamber 30 with the full bore section 12; however, in FIG. 4, the piston 16 blocks the first port 30*a*. In FIG. 4, the seal 28 prevents the first port 30*a* of the annular sample chamber 30 from fluidly communicating with the first port 16***a* of the piston 16 and the full bore section 12.

FIG. 5 follows FIG. 4 in illustrating the annular sample chamber 30 which is disposed between the outer housing 22 and the piston 16. As noted earlier, the piston 16 is axially moveable in response to an annulus pressure around the sampler 20 exerted on the piston. A seal 32 in FIG. 5 seals the piston 16 to a portion 22*a* of the housing 22. Since a fluid will be trapped in the annular sample chamber 30, the seal prevents any of the fluid from leaking into a space between the piston 16 and the housing 22.

In FIG. 6, the portion 22*a* of the housing is threadedly connected to another portion 22*b* of the housing 22. The piston 16 continues to traverse the length of the apparatus shown in FIGS. 2–8 of the drawings. Therefore, the piston 16 traverses the length of the formation fluid sampler 20 in FIG. 6. In FIG. 6, the piston 16 includes a second port 16*b* which is transversely disposed through the piston 16. A seal 34 is disposed adjacent the second port 16*b* for sealing off the annular sample chamber 30 from the second port 16*b* and the full bore section 12 of the sampler 20 when the piston 16 is situated in the position shown in FIG. 6. The annular sample chamber 30 includes a second port 30*b* adapted for fluidly communicating the annular sample chamber 30 with the second port 16*b* of piston 16 when the piston 16 is moved downwardly to a position wherein the second port 16*b* of piston 16 is congruent with the second port 30*b* of the annular sample chamber 30. Seal 24 is disposed on one side of the second port 30*b* of annular sample chamber 30, and another seal 36 is disposed on the other side of the second port 30*b*. Therefore, fluid in the annular sample chamber 30 cannot flow to the full bore section 12 via second port 30 *b* because seals 34 and 36 block the flow.

FIG. 4 illustrates the first port 16*a* of the piston 16 and the first port 30*a* of the annular sample chamber 30 dispose on one side of the annular sample chamber 30. However, FIG. 6 illustrates the second port 16*b* of the piston 16 and the second port 30*b* of the annular sample chamber 30 disposed on the other side of the annular sample chamber 30. As noted earlier, the piston 16 is axially moveable downwardly in FIGS. 2–11 of the drawings. Therefore, when the piston 16 moves downwardly to a specific position in response to an annulus pressure which exists around the sampler 20 in the wellbore, the first port 16*a* and the first port 30*a* are congruent with one another, and the second port 16*b* and the second port 30*b* are also congruent with one another. First ports 16*a*/30*a* and second ports 16*b*/30*b* are disposed on both sides of and flank the the annular sample chamber 30. When the first and second ports 16*a*/30*a* and 16*b*/30*b* are congruent with one another, fluid communication exists between the full bore section 12 and annular sample chamber 30 via second ports 16*b*/30*b* and between annular sample chamber 30 and full bore section 12 via first ports 16*a*/30*a*. See the functional description of the sampler of the present invention set forth below.

Figure 7:
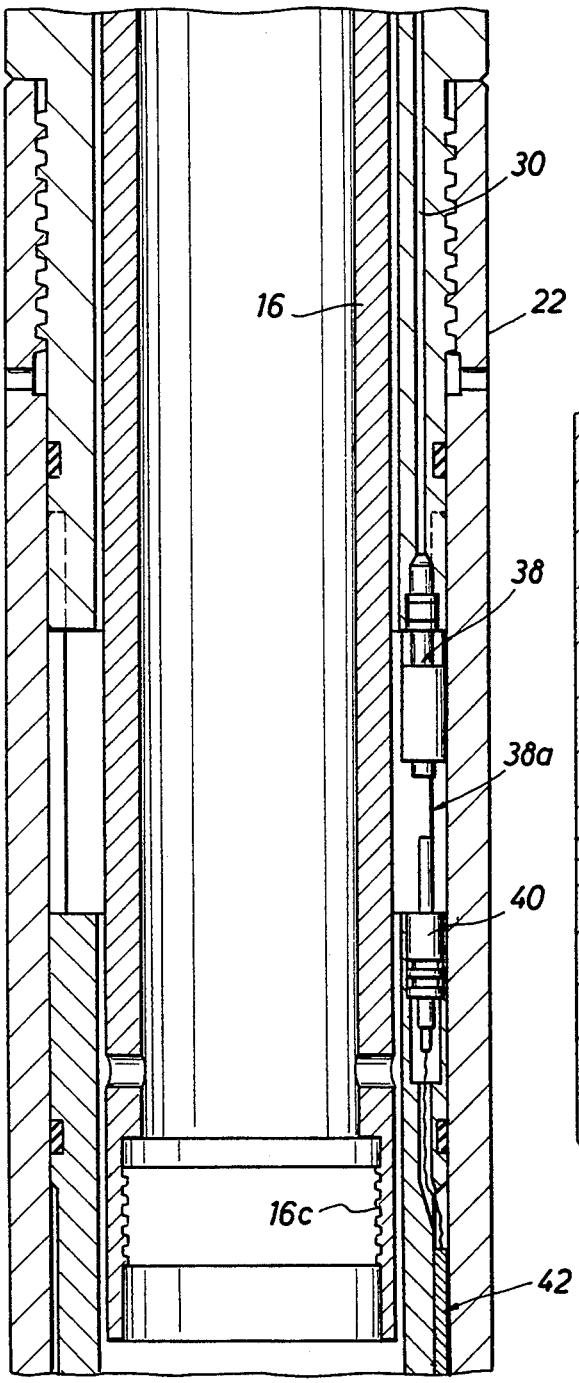

In FIG. 7, the annular sample chamber 30 is disposed between the downwardly moveable piston 16 and the outer housing 22. The piston 16 in FIG. 7 includes an end portion 16*c* which is adapted to threadedly connect with an end portion 16*d* of piston 16 in FIG. 9 of the drawings. A formation fluid parameter transducer 38 is disposed at the bottom end of the annular sample chamber 30 within housing 22 for sensing a parameter of the fluid sample, such as temperature and/or pressure, disposed in the annular sample chamber 30, the parameter being the value which existed at the precise moment in time when the fluid sample was initially taken by the sampler 20. For example, if the transducer 38 is a temperature transducer, the temperature measured by the transducer 38 will be that temperature of the formation fluid which existed at the time when the formation fluid sample was initially taken by the sampler 20. The transducer 38 converts the sensed parameter (temperature and/or pressure) into electrical signals indicative of the sensed parameter. An erasable, programmable, read only memory (EPROM) 40 is electrically connected to the transducer 38 for receiving the electrical signals from the transducer and storing the signals therein. As a result, the measured parameter, such as temperature and/or pressure, of the formation fluid in the annular sample chamber 30, measured by the transducer 38 at the precise moment in time when the sample was initially taken, is stored in the EPROM memory 40. The EPROM 40 is powered by a battery 42 which is connected to the EPROM.

Figure 8:
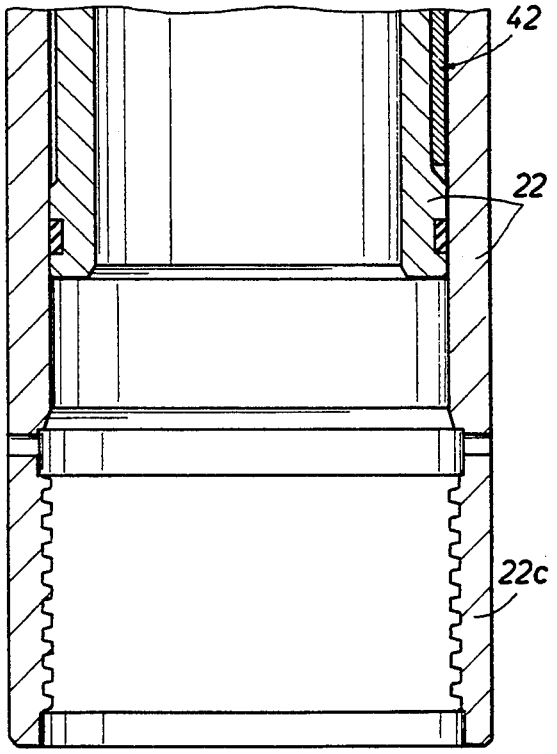

Therefore, when the sampler 20 is removed from the wellbore, the measured parameter of the formation fluid (such as temperature or pressure) stored in the EPROM 40 will represent that value of the parameter of the fluid sample which existed at the precise moment in time when the fluid sample was initially taken by the sampler 20. In FIGS. 7 and 8, an end portion 22*c* of outer housing 22 is adapted to be connected to an end portion 22*d* of the outer housing 22 shown in FIG. 9; and an end portion 16*c* of piston 16 in FIG. 7 is adapted to threadedly connect with an end portion 16*d* of piston 16 in FIG. 9 of the drawings.

Figure 9:
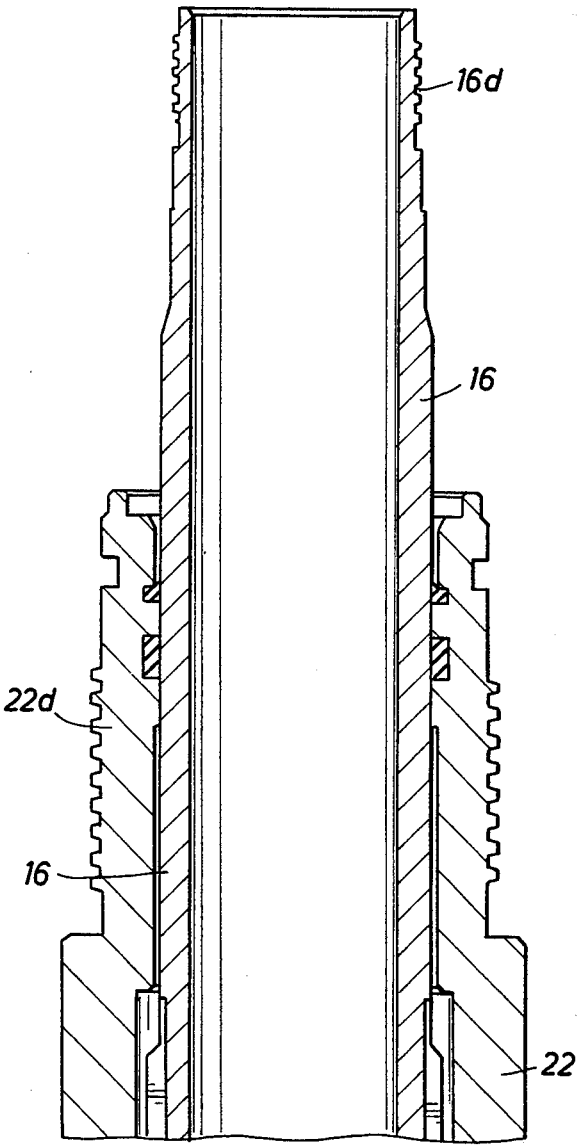
FIGS. 9 through 11 illustrate a port which fluidly communicates the annulus around the sampler in the wellbore with a shoulder of the axially moveable, spring-biased piston.
Figure 10:
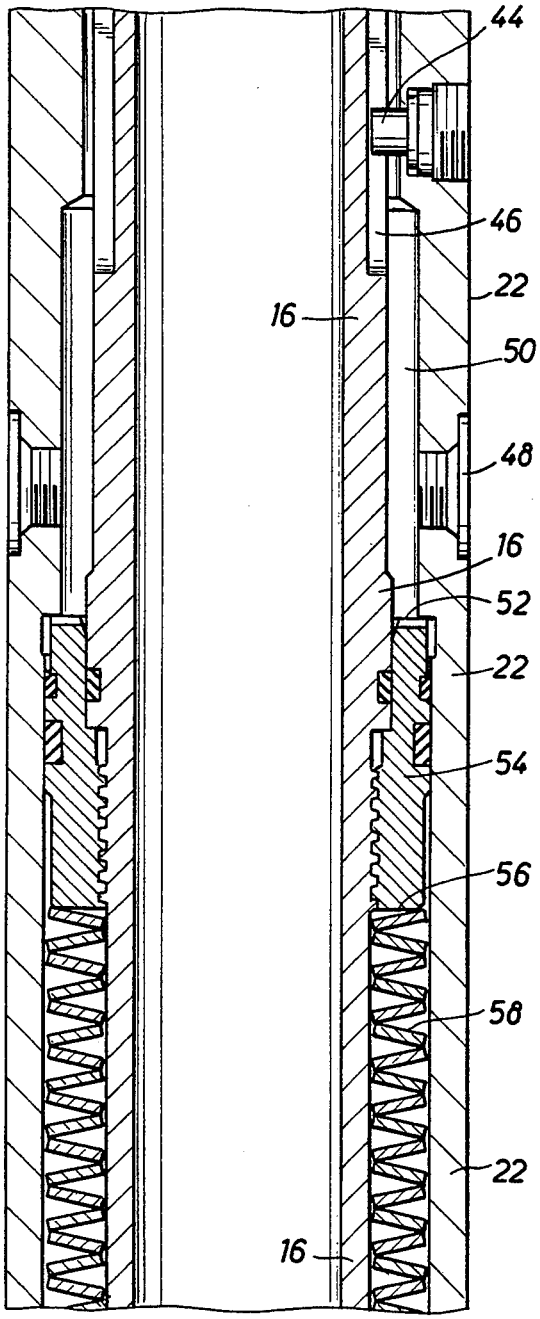
Figure 11:
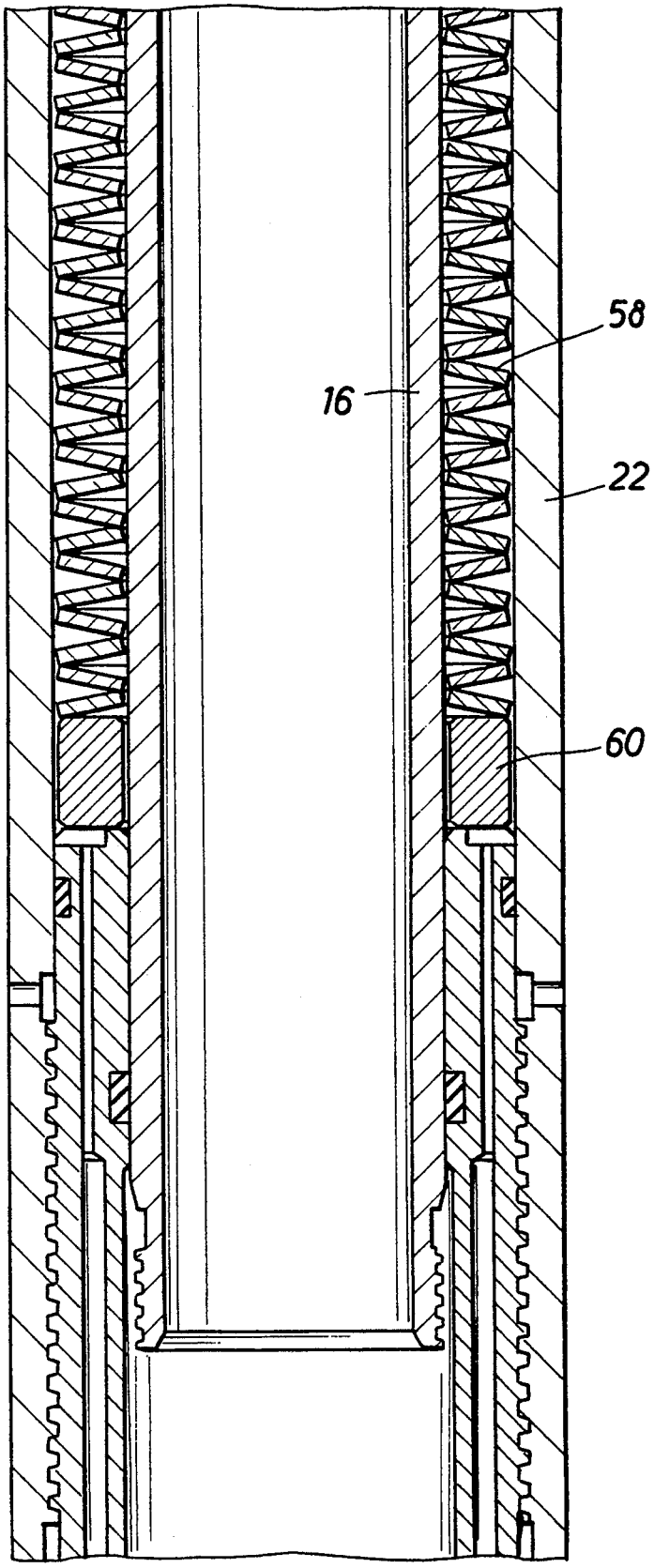

Referring to FIGS. 9–11, FIGS. 9–11 illustrate a port which fluidly communicates an annulus around the sampler in the wellbore with a shoulder of the axially moveable, spring-biased piston 16.

In FIG. 9, the end portion 22*d* of outer housing 22 connects with the end portion 22*c* in FIG. 8, and the end portion 16*d* of piston 16 connects with the end portion 16*c* of piston 16 in FIG. 7.

In FIG. 10, the outer housing 22 includes another key 44 which is adapted to ride within another slot 46. As a result, the piston 16 cannot rotate circumferentially within the outer housing 22. The outer housing 22 further includes a port 48 which is adapted to communicate the annulus area around the sampler 20, when disposed in a wellbore, with an internal area 50 disposed between the outer housing 22 and the piston 16 in FIG. 10. An annulus pressure exists within the annulus area around the sampler 20 when disposed in the wellbore, and this annulus pressure flows through the port 48 and is exerted on an upper transverse working surface or shoulder 52 associated with a sub 54 which is disposed between the piston 16 and the outer housing 22. The sub 54 is threadedly connected to the piston 16. A lower transverse working surface 56 of the sub 54 is biased upwardly by a spring 58 also disposed between piston 16 and outer housing 22.

In FIG. 11, although one end of the spring 58 contacts the lower transverse working surface 56 of the sub 54, the other end of the spring 58 contacts a stationary sub 60. Therefore, when the sub 54 tends to move downwardly in FIG. 10 against the upward force of the spring 58 in response to the annulus pressure around the sampler 20 in the wellbore working on the shoulder 52, since the piston 16 is threadedly connected to the sub 54, the piston 16 also tends to moves downwardly.

A functional description of the sampler 20 of the present invention, in association with the full bore valve 10, the port 48 and the spring 58, will be set forth in the following paragraphs with reference to FIGS. 2 through 11 of the drawings.

The following initial conditions apply. The ball valve 10 of FIG. 2 is assumed to be in the closed position, and the apparatus shown in FIGS. 2–11 is disposed in a wellbore. A packer is set, and an annulus area below the set packer (called the rathole) is isolated from an annulus area above the set packer. A formation traversed by the wellbore has been perforated and a well fluid flows from the perforated formation. The well fluid flowing from the formation fills the full bore section 12 of the apparatus disposed below the closed ball valve 10 in FIG. 2. The first port 16*a* of the piston is not congruent with the first port 30*a* of the annular sample chamber 30, as shown in FIG. 4. As a result, the first ports 16*a*/30*a* are closed. The second port 16*b* of the piston 16 is not congruent with the second port 30*b* of the annular sample chamber 30, as shown in FIG. 6. As a result, the second ports 16*b*/30*b* are closed. No data is stored in the EPROM 40 of FIG. 7. The annular sample chamber 30 is empty. The spring 58 of FIG. 10 is not compressed; as a result, the sub 54 is disposed in its uppermost position, as shown in FIG. 10.

Assume the annulus pressure in the annulus above the set packer 17 is increased. The annulus pressure enters port 48 in FIG. 10 and is exerted on the upper working surface or shoulder 52 of sub 54. As a result, the sub 54 tends to move downwardly in FIG. 10 against the biasing force of the spring 58. Since the sub 54 is threadedly connected to piston 16 in FIG. 10, the piston 16 also tends to moves downwardly. Keys 24 and 44 prevent the piston 16 from moving circumferentially relative to outer housing 22. The piston 16 in FIGS. 2 through 11 moves downwardly in response to the annulus pressure working on the shoulder 52 of sub 54. Since the piston 16 is moving downwardly, the first port 16*a* of piston 16 eventually moves into congruence with the first port 30*a* of the annular sample chamber 30 (FIG. 4) and the second port 16*b* of piston 16 eventually moves into congruence with the second port 30*b* of the annular sample chamber 30 (FIG. 6). That is, the ports 16*a*/30*a* and 16*b*/30*b* begin to open. At the same time, since the piston 16 moved downwardly, the pin 10*a* of ball valve 10 moves downwardly thereby opening the ball valve 10 in the full bore section 12 (FIG. 2). Since the ball valve 10 is now open, the well fluid in the full bore section 12 begins to flow upwardly to the wellbore surface. However, the well fluid also flows into the second port 16*b* of the piston 16, into the second port 30*b* of the annular sample chamber 30, and into the annular sample chamber 30 of figure. The well fluid also flows out of the annular sample chamber 30, into the first port 30*a* of the annular sample chamber, into the first port 16*a* of the piston 16, and back into the full bore section 12 of the apparatus shown in FIG. 4. When the well fluid flows into the annular sample chamber 30 via second port 30*b* in FIG. 6, the well fluid also flows downwardly to the formation fluid parameter transducer 38 in FIG. 7. The transducer 38 measures a parameter of the formation fluid, such as temperature or pressure, and converts the measurement into electrical signals. The electrical signals propagate along conductor 38*a* to the EPROM memory 40 in FIG. 7, where the electrical signals, representing a formation parameter such as temperature or pressure, are stored in the EPROM memory 40.

The annulus pressure is decreased. As a result, the spring 58 in FIG. 10 begins to bias the sub 54 upwardly. As a result, the piston 16 moves upwardly in response to the upward movement of the sub 54 and the biasing force of the spring. The first and second ports 16*a* and 16*b* of the piston 16 begin to move out of congruence with the first and second ports 30*a* and 30*b* of the annular sample chamber 30. That is, the ports 16*a*/30*a* and 16*b*/30*b* begin to close. At the same time, the pin 10*a* of the ball valve 10 moves upwardly thereby closing the ball valve 10. The fluid sample present in the annular sample chamber 30 is trapped in the chamber when the ports 16*a*/30*a* and 16*b*/30*b* close. In addition, the parameter of the formation fluid, such as temperature and/or pressure, trapped in the annular sample chamber 30 is recorded in the EPROM memory 40 in FIG. 7. This parameter stored in memory 40 represents the parameter, such as temperature or pressure, of the fluid sample which was measured at the precise moment in time when the fluid sample was initially taken by the sampler 20 of the present invention. When the sampler 20 is removed to the wellbore surface, one can easily read-out the measured parameter of the fluid sample from the memory 40 to determine the actual parameter of the formation fluid when it was received in the annular sample chamber.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An apparatus adapted to be disposed in a wellbore for sampling a fluid produced from a formation traversed by said wellbore, comprising:

a housing defining an interior full bore space, said fluid adapted to flow from said formation into said interior full bore space, said housing including, an annular sample chamber adapted for receiving said fluid from said interior full bore space, and transducer means fluidly connected to said annular sample chamber for receiving a portion of said fluid from said annular sample chamber when said fluid is initially received from said interior full bore space into said annular sample chamber and measuring a characteristic of said fluid, said transducer means generating an output signal indicative of said characteristic of said fluid when the characteristic is measured by said transducer means.

2. The apparatus of claim 1, wherein said housing further comprises:

memory means electrically connected to said transducer means and responsive to said output signal from said transducer means for storing said characteristic of said fluid.

3. The apparatus of claim 2, wherein said housing further comprises:

a first port fluidly communicating said annular sample chamber in said housing with said interior full bore space; and a second port fluidly communicating said annular sample chamber in said housing with said interior full bore space.

4. The apparatus of claim 3 further comprising a piston enclosed by said housing and adapted to move longitudinally with respect to said housing, said piston including a first port and a second port, said first port of said piston being moved into congruence with said first port of said housing when said piston is moved longitudinally with respect to said housing, said second port of said piston being moved into congruence with said second port of said housing when said piston is moved longitudinally with respect to said housing, said second port of said piston and said second port of said housing fluidly communicating said interior full bore space with said annular sample chamber when said second port of said piston moves into congruence with said second port of said housing, said first port of said piston and said first port of said housing fluidly communicating said annular sample chamber with said interior full bore space when said first port of said piston moves into congruence with said first port of said housing.

5. The apparatus of claim 4, wherein an annulus area is defined by said apparatus and a wall of said wellbore when said apparatus is disposed in said wellbore, an annulus pressure existing in said annulus area, said piston including a shoulder, wherein said housing further comprises:

a third port communicating said annulus area with said shoulder of said piston, said annulus pressure from said annulus area having access to said shoulder of said piston via said third port, said annulus pressure being exerted on said shoulder of said piston when said annulus pressure accesses said shoulder of said piston, said piston moving longitudinally with respect to said housing in response to said annulus pressure when said annulus pressure is exerted on said shoulder of said piston.

6. The apparatus of claim 5, wherein said first port of said piston moves into congruence with said first port of said housing and said second port of said piston moves into congruence with said second port of said housing when said piston moves longitudinally with respect to said housing in response to said annulus pressure being exerted on said shoulder of said piston.

7. The apparatus of claim 6, further comprising:

valve means disposed within said interior full bore space of said housing and connected to said piston for opening and closing thereby opening and closing said interior full bore space of said housing in response to the longitudinal movement of said piston with respect to said housing.

8. The apparatus of claim 7, wherein said valve means opens said interior full bore space of said housing when said first port of said piston moves into congruence with said first port of said housing and said second port of said piston moves into congruence with said second port of said housing in response to the longitudinal movement of said piston.

9. A method of taking a sample of a formation fluid flowing from a formation traversed by a wellbore, comprising the steps of:

receiving said sample in a sample chamber of a fluid sampler, said fluid sampler including a housing defining a full bore, said housing including said sample chamber where said sample chamber includes an annular sample chamber, a first port adapted for fluidly communicating said annular sample chamber with said full bore, and a second port adapted for fluidly communicating said annular sample chamber with said full bore said sample initially flowing in said full bore, the receiving step including the steps of opening said first port and said second pork, receiving said sample from said full bore into said second port and flowing said sample from said second port into said annular sample chamber; and immediately measuring a characteristic of said sample when said sample is received in said sample chamber of said fluid sampler.

10. The method of claim 9, further comprising the steps of:

storing said characteristic of said sample measured during the measuring step in a memory.

11. The method of claim 9, wherein said housing further includes a transducer fluidly connected to said annular sample chamber adapted for measuring said characteristic of said sample received in said annular sample chamber, the measuring step comprising the step of:

flowing said sample from said annular sample chamber into contact with said transducer, said transducer measuring said characteristic of said sample when said sample contacts said transducer.

12. The method of claim 11, further comprising the steps of:

storing the characteristic measured during the measuring step in an electronic memory.

13. The method of claim 12, wherein said housing includes a memory apparatus electrically connected to said transducer, said transducer generating an output signal representative of said characteristic of said sample when said transducer measures said characteristic of said sample, the storing step comprising the step of:

receiving said output signal from said transducer representative of said characteristic of the sample; and storing said output signal from said transducer in said memory apparatus.

14. The method of claim 9, further comprising the steps of:

flowing said sample from said annular sample chamber into said first port and flowing said sample from said first port into said full bore; and closing said first port and said second port.

15. An apparatus adapted to be disosed in a wellbore for sampling a fluid produced from a formation traversed by said wellbore, comprising:

a housing defining a full bore, said fluid adapted to flow in said full bore, said housing including, an annular sample chamber adapted for receiving said fluid from said full bore and trapping said fluid therein, a first port adapted to fluidly communicate said annular sample chamber with said full bore, and a second port adapted to fluidly communicate said annular sample chamber with said full bore; and a piston enclosed by said housing and adapted to move longitudinally with respect to said housing, said piston including a first port adapted to move into congruence with said first port of said housing and a second port adapted to move into congruence with said second port of said housing when said piston moves longitudinally with respect to said housing, said first port of said housing and said first port of said piston fluidly communicating said annular sample chamber with said full bore when said first port of said piston moves into congruence with said first port of said housing, said second port of said housing and said second port of said piston fluidly communicating said annular sample chamber with said full bore when said second port of said piston moves into congruence with said second port of said outer housing.

16. The apparatus of claim 15, wherein an annulus area is defined by said apparatus and a wall of said wellbore when said apparatus is disposed in said wellbore, an annulus pressure existing in said annulus area, said piston including a shoulder, and wherein said housing further comprises:

a third port communicating said annulus area with said shoulder of said piston, said annulus pressure from said annulus area having access to said shoulder of said piston via said third port, said annulus pressure being exerted on said shoulder of said piston when said annulus pressure accesses said shoulder via said third port, said piston moving longitudinally with respect to said housing in response to said annulus pressure being exerted on said shoulder of said piston.

17. The apparatus of claim 16, wherein said first port of said piston moves into congruence with said first port of said housing and said second port of said piston moves into congruence with said second port of said housing when said piston moves longitudinally with respect to said housing in response to said annulus pressure being exerted on said shoulder of said piston.

18. The apparatus of claim 17, further comprising:

valve means disposed within said full bore of said housing and connected to said piston for opening and closing thereby opening and closing said full bore in response to the longitudinal movement of said piston with respect to said housing.

19. The apparatus of claim 18, wherein said valve means opens said full bore of said housing when said first port of said piston moves into congruence with said first port of said housing and said second port of said piston moves into congruence with said second port of said housing in response to the longitudinal movement of said piston with respect to said housing.

20. A method of receiving a sample of a formation fluid flowing from a formation traversed by a wellbore in a sample chamber of a fluid sampler, said fluid sampler including a housing defining a full bore, said sample initially flowing in said full bore, said housing including said sample chamber where said sample chamber includes an annular sample chamber for receiving said sample of said formation fluid flowing in said full bore, a first port for fluidly communicating said annular sample chamber with said full bore, a second port for fluidly communicating said annular sample chamber with said full bore, and a transducer fluidly connected to said annular sample chamber for measuring a characteristic of said sample of said formation fluid, comprising the steps of:

opening said first port and said second port;

receiving said sample from said full bore into said second port and flowing said sample from said second port into said annular sample chamber; and using said transducer, measuring said characteristic of said sample of said formation fluid.

21. The method of claim 20, wherein said housing includes an electronic memory electrically connected to said transducer, said transducer generating an output signal representative of the characteristic of said sample measured by said transducer, and wherein the measuring step further comprises the step of:

storing said characteristic of said sample in said memory in response to said output signal from said transducer.

22. The method of claim 21, wherein said characteristic of said sample is a temperature of said sample of said formation fluid.

23. The method of claim 21, wherein said characteristic is a pressure of said sample of said formation fluid.

24. The method of claim 21, further comprising the steps of:

flowing said sample from said annular sample chamber into said first port and flowing said sample from said first port into said full bore; and closing said first port and said second port.

25. A fluid sampler adapted to be disposed in a wellbore for receiving a sample of a wellbore fluid produced from a formation traversed by said wellbore, comprising:

a sample chamber adapted for receiving said sample of said wellbore fluid, sensor means fluidly connected to said sample chamber for receiving a portion of said sample of said wellbore fluid, measuring a characteristic of said portion of said sample, and generating an output signal representative of said characteristic, electronic memory means electrically connected to said sensor means and responsive to said output signal for storing said characteristic of said portion of said sample therein, and a housing defining a full bore, said wellbore fluid adapted to flow in said full bore, said housing further including first port means for fluidly communicating said sample chamber with said full bore.

26. The fluid sampler of claim 25, wherein an annulus is defined by said fluid sampler and said wellbore when said fluid sampler is disposed in said wellbore, an annulus pressure existing in said annulus, and wherein said fluid sampler further comprises:

piston means enclosed by said housing for moving in response to said annulus pressure in said annulus, said piston means including second port means for moving into and out of congruence with said first port means of said housing in response to the movement of said piston means.

27. The fluid sampler of claim 26, further comprising:

valve means disposed within said full bore for opening and closing said full bore in synchronism with the movement of said second port means of said piston means into and out of congruence with said first port means of said housing.

* * * * *